US006622457B2

(12) United States Patent
Kurth

(10) Patent No.: US 6,622,457 B2
(45) Date of Patent: Sep. 23, 2003

(54) ASEPTICALLY WORKING PACKAGING MACHINE AND METHOD FOR PRE-STERILIZING THEM

(75) Inventor: Gunter Kurth, Ranstadt (DE)

(73) Assignee: Hassia Verpackungsmaschinen GmbH, Ranstadt (DE)

( * ) Notice: Subject to any disclaimer, the term of this patent is extended or adjusted under 35 U.S.C. 154(b) by 58 days.

(21) Appl. No.: 09/913,415

(22) PCT Filed: Dec. 11, 2000

(86) PCT No.: PCT/DE00/04415

§ 371 (c)(1),
(2), (4) Date: Aug. 13, 2001

(87) PCT Pub. No.: WO01/44053

PCT Pub. Date: Jun. 21, 2001

(65) Prior Publication Data

US 2002/0134051 A1 Sep. 26, 2002

(30) Foreign Application Priority Data

Dec. 14, 1999 (DE) ..... 199 60 155

(51) Int. Cl.[7] ..... B65B 55/02
(52) U.S. Cl. ..... 53/425; 53/426
(58) Field of Search ..... 53/167, 425, 426, 53/451, 453, 551, 561; 422/26, 292–300

(56) References Cited

U.S. PATENT DOCUMENTS

| | | | | | |
|---|---|---|---|---|---|
| 3,820,300 A | | 6/1974 | Reinecke et al. | | |
| 3,942,299 A | * | 3/1976 | Bory | 53/425 |
| 4,296,068 A | * | 10/1981 | Hoshino | 422/62 |
| 4,707,334 A | * | 11/1987 | Gerhard | 422/28 |
| 5,007,232 A | * | 4/1991 | Caudill | 53/426 |
| 5,173,259 A | * | 12/1992 | Bordini | 422/28 |
| 5,178,841 A | * | 1/1993 | Vokins et al. | 422/298 |
| 5,258,162 A | * | 11/1993 | Andersson et al. | 422/28 |
| 5,534,222 A | * | 7/1996 | Kelbrick et al. | 422/33 |
| 6,330,780 B1 | * | 12/2001 | Shipway | 53/426 |

FOREIGN PATENT DOCUMENTS

| | | |
|---|---|---|
| DE | 24 35 037 | 11/1986 |
| DE | 37 28 595 | 3/1989 |
| DE | 197 26 222 | 12/1998 |
| EP | 0 180 540 | 5/1986 |

* cited by examiner

*Primary Examiner*—Scott A. Smith
*Assistant Examiner*—Chukwurah Nathaniel
(74) *Attorney, Agent, or Firm*—Collard & Roe, P.C.

(57) ABSTRACT

An aseptically operating packing machine comprises a processing track with tools for treating a packing sheet arranged in a sterile chamber partially open to the atmosphere. Heated sterile air is blown through a sterile air filter, and a mixing nozzle is arranged downstream directly behind the filter within an ari channel terminating in the sterile chamber. The mixing nozzle is connected to a steam- and sterilizing agent-supply conduit and points downstream towards the sterile chamber. A tank in the sterilizing supply conduit holds the sterilizing agent under constant pressure, and a steam volume regulator is arranged in the steam supply conduit.

12 Claims, 2 Drawing Sheets

ASEPTICALLY WORKING PACKAGING MACHINE AND METHOD FOR PRE-STERILIZING THEM

CROSS REFERENCE TO RELATED APPLICATIONS

Applicant claims priority under 35 U.S.C. §119 OF German Application No. 199 60 155.0 filed. Dec. 14, 1999. Applicant also claims priority under 35 U.S.C. §365 of PCT/DE00/04415 filed Dec. 11, 2000. The international application under PCT article 21(2) was not published in English.

BACKGROUND OF THE INVENTION

1. Field of the Invention

The present invention is concerned with aseptically operating packing machines and a process for the pre-sterilization thereof. The term "packing machines" in the present instance, in particular, refers to two types of machines, to wit, on the one hand, machines wherein the web of packing material of suitable thermoplastic plastic or plastic compound foil, by deep drawing, is cyclically fed through the machine, preheated, heated molded by deep-drawing to form containers that are loaded and then sealed by a cover foil, and, on the other hand, machines forming so-called tubular bags wherein the web of packing material is also cyclically molded to form a hose to be longitudinally sealed, with the hose being sealed at the bottom by a transverse seal, then filled and, after withdrawal, closed at the top equally by a transverse seal and then severed from the hose automatically supplied.

2. Description of the Prior State of Art

The package of foodstuffs and semi-luxuries in containers correspondingly molded from webs of packing sheet is required to be in sterile, i.e. substantially aseptical condition. For that purpose, aspetically operating packing machines of the afore-mentioned type are available in the art that have sterile spaces in which are provided the processing or treatment tools for the web of packing foil. In deep-drawing packing machines the processing elements are pre-heating plates, the deep-drawing tools and the filling and sealing elements for the cyclically passing web of packing sheet, while in tubular bag packing machines the said processing elements form the tubular molding and loading stations including the heatable longitudinally sealing tools and all guiding elements for the web of packing sheet located ahead of that station. During operation at a slight excess pressure, sterile air is continuously supplied to the sterile spaces of such machines to maintain the sterile atmosphere clear of re-contamination during operation, insuring that at predetermined points of the sterile spaces the sterile air also can again flow out of the sterile space. After an operational close-down of machines of the afore-described type, be it for shift end reasons or otherwise, it will be necessary to render the aseptic spaces and the afore-mentioned processing tools contained therein again sterile prior to re-putting them into operation.

DE 24 35 037 C2 discloses, for example, a process of pre-sterilizing the surfaces of items wherein the surfaces, prior to supplying hydrogen peroxide (so-called peroxide) as the sterilizing agent, initially, are treated with a flow of water vapor to regularly heat all surfaces to be treated. It is only after such a heating process that peroxide is admixed to the steam, thereby additionally raising the temperature thereof. After having been so pre-sterilized the subsequently introduced peroxide is washed away by non-heated sterile air. As the desired heating of the surfaces, inevitably, involves wetting of the surfaces with condensate containing no sterilizing agent it will have to be left unconsidered to what extent the mixture of sterilizing agent and steam supplied in a second step can take full effect. As, moreover, such sterile spaces and the processing tools contained therein are not clear of corners or gaps, it is unavoidable, that during pre-steaming, such corners or gaps cannot be reached any longer by the peroxide subsequently admixed to the steam because they are quasi already blocked by pure steam condensate, i.e. by water. Apart therefrom this process does not safeguard that the germs protected by the condensate drops are reached by the sterilizing agent at the required concentration because the sterilizing mixture is prevented therefrom due to the condensate already deposited. Another disadvantage resides in that the surfaces to be sterilized are so heated by the steam and by subsequent additional steaming, while adding sterilizing agent, that the mixture of steam/sterilizing agent no longer is safely condensed on all surfaces. The dilemma is that the chemical reactivity of the condensing (i.e. liquid) sterilizing agent, on the one hand, is enhanced, while on the other hand, in view of the destruction of micro-organisms and spores, the chemical reactivity markedly decreases once the sterilizing agent no longer is in liquid form but passes to the gaseous (vaporous) state.

DE 197 26 222 A1 is equally concerned with the question of pre-sterilization especially in connection with a mechanism specifically designed herefore and provided with a so-called reversible blower in order to have gaseous or vaporous sterile agent flow through the sterile spaces along with the tools contained therein in two different directions. Apart from the reversible blower required herefore, this mechanism involves out-of-proportion mechanical efforts, i.e. a large number of conduits and a substantial number of re-switchable valves requiring corresponding valve control means. Moreover, in the afore-described mechanism the sterilizing agent is introduced between two filters involving the danger of that the fine filter coupled to the blower is decomposed. Also, it will have to be left unconsidered how much of the sterilizing agent is retained by the filter or is already chemically reacted in the filter material so that it does not or not in time reach the tunnel or tubing area to be pre-sterilized during the production phase.

A pre-sterilization of a sterile tunnel is also provided with an arrangement according to U.S. Pat. No. 3,820,300, wherein a liquid sterilizing agent is injected into the sterile air supplied prior to commencement of the actual packing processing. After completion of the pre-sterilization, the injection of the sterilizing agent is simply discontinued. The supply of the mixture consisting of sterile air and sterilizing agent as well as the subsequent exclusive supply of sterile air are effectuated in a way similar to DE 197 26 222 A1 via a complex multiplicity of individual nozzles distributed throughout the sterile space, which, individually, are difficult to control and which are connected to so-called "distributors". Corners or gaps which are the preferred places, as mentioned before, for bacteria invasions, cannot be reached thereby because the sterile air being the carrier of the injected sterilizing agent has no reason to penetrate such corners or gaps in communication with the atmosphere, let alone that a supplied gaseous sterilizing agent formed of the mixture of sterile air and sterilizing agent has, as mentioned before, a lower sterilizing effect than a condensing (i.e. locally liquid) sterilizing agent.

SUMMARY OF THE INVENTION

In the light of the afore-going it is the object of the invention not only to carry out the required pre-sterilization in a satisfactory way but also to minimize the mechanical efforts, using the supply of sterilizing air anyway required for normal package operations as a controllable conveying means for a mixture of steam and sterilizing agent supplied at a mixture ratio predetermined from the very start, insuring at the same time that the said total mixture will find such temperature conditions in the space to be sterilized and on the processing tools contained therein, that, on the one hand, an unimpeded condensation of the mixture of steam and sterilizing agent on all surfaces and in the gaps and crevices be safeguarded and, on the other hand, the temperature-dependent chemical reactivity of the sterilizing agent be optimally secured by a defined temperature regulation.

Proceeding from the traditional practice according to which prior to putting into operation the packing machine concerned, a sterilizing agent, such as hydrogen peroxide or the like, is sprayed into the sterile space and, after the said pre-sterilization, sterile air, during the operative period or during the packing process, is permanently supplied to and discharged from the sterile chamber, the problem involved with the pre-sterilization process according to the invention has been solved by the following process steps:

a) the treatment elements in the sterile chamber which might still be hot, prior to commencing the pre-sterilization process, are brought to a temperature below 120° C.;

b) the mixture of water vapor being the carrier medium, and sterilizing agent is effectuated by means of a nozzle to which both components are supplied;

c) the mixture of water vapor and sterilizing agent is introduced at a single point, downstream, directly behind the sterile filter in the same direction as the incoming sterile air serving as the carrier medium, directed toward the sterile chamber;

d) the steam supply to the nozzle is effectuated by a pressure relief valve and a subsequent means regulating the steam volume, whereas the supply of sterilizing agent to the nozzle is from a stock of sterilizing agent held at a constant pressure, and e) during the pre-sterilizing start-up phase, the supply of sterile air is temporarily discontinued for the generation of a partial return flow of the discharged mixture of water vapor and sterilizing agent, upstream, toward the sterile air filter.

The aseptically operating packing machine still comprises, as it did in the past, a processing track furnished with elements for treating the web of packing foil in a sterile chamber partially open toward the atmosphere and provided with elements for the supply of sterile agent and with a nozzle for a generator of sterile air furnished with blower, heater and sterile filter. In the practice of the invention, a packing machine of the afore-described type, for pre-sterilizing purposes, is furnished with the following:

Downstream, directly behind the sterile air filter, is disposed, within a sterile air passageway terminating in the sterile chamber, a mixing nozzle connected to conduits for feeding steam and sterilizing agent, which is arranged toward the direction of the termination of the sterile air passageway in the sterile chamber, with a tank allocating the sterilizing agent held at a constant pressure and provided with a pressure relief valve disposed ahead thereof being disposed in the sterilizing agent supply line, and a pressure relief valve including means for regulating the steam volume being provided in the steam supply conduit.

In the light of the afore-going, the invention is not restricted to the simple feature of reducin a multiplicity of spraying ports according to DE 197 26 222 A1 and U.S. Pat. No. 3,820,300 to one single port, as this measure alone would not achieve a satisfactory pre-sterilization of the entire sterile chamber; the afore-mentioned additional process features and objects will be necessary, as on the one hand, a special arrangement (utilization of the sterile air flow) and a directional orientation of the mixing nozzle have proved to be necessary and, on the other hand, a mixing ratio of steam and sterilizing agent insuring a satisfactory germ destruction will have to be taken into consideration. In addition, due to the arrangement of the mixing nozzle directly downstream behind the sterilizing air filter, the latter is most easily and controllably incorporated into the pre-sterilizing process in that the sterile air blower is simply turned off for a short period of time. Moreover, the feature of the temperature decrease of the elements of treatment insures that the subsequently introduced mixture of sterilizing agent can condense throughout the place, including all corners and gaps without being affected by moisture otherwise already contained therein. Preferably and with advantage, the temperature is decreased to a value below the condensation temperature of the mixture of steam and sterilizing agent.

BRIEF DESCRIPTION OF THE DRAWINGS

The process of the invention and aseptically operating packing machines to be pre-sterilized thereby, including advantageous embodiments thereof, will now be described in greater detail with reference to the graphical illustration of some forms of embodiment, wherein.

DESCRIPTION OF PREFERRED FORMS OF EMBODIMENT

Figure 1:
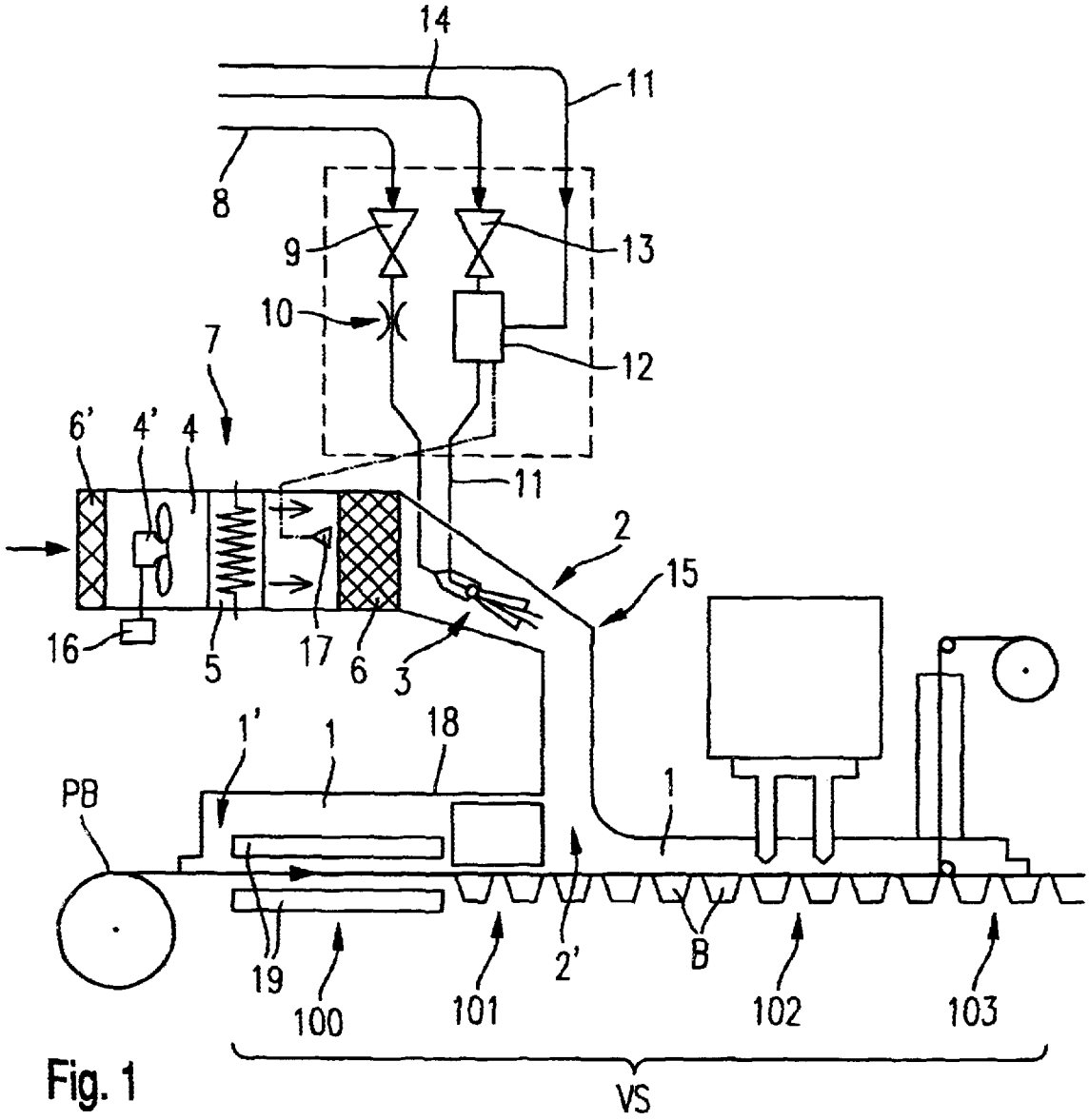
FIG. 1 schematically shows a side and sectional view of a packing machine designed according to the invention for molding, filling and sealing of containers in the form of beakers.

Referring to the drawings, FIG. 1 shows an aseptically operating deep-drawing packing machine for making and filling of beakers, the processing track VS of which for the web of packing foil PB is covered by a so-called sterile tunnel 18 externally confining the sterile chamber 1 and including a sterile air supply channel 2 and containing the schematically shown stations 100, 101, 102, 103 for pre-heating of foils, molding, loading and sealing the beaker-type containers B. Concerning such a machine, reference is made to EP 0 727 357 A2.

To comply with the requirement of the process of the invention for pre-sterilizing the sterile chamber 1, namely to introduce the sterilizing agent mixed with water vapor as the carrier medium, at a single point, downstream, behind the sterile air filter 6 from the sterile air supply area toward the sterile chamber 1, effectuating the steam supply through a pressure relief valve 9 for adjusting a constant steam pressure followed by a regulation of the steam volume, and to feed the sterilizing agent usually dissolved in a 35% aqueous solution at a constant pressure to the mixing point, it is important to the machine to provide, downstream, directly behind the sterile air filter 6, within the sterile air channel 2 terminating in the sterile chamber 1, a mixing nozzle 3 connected to a steam- and a sterile agent-carrying conduit 8, 11 and so arranged that it points toward the termination 2' of the sterile air passageway 2 opening in the sterile chamber 1. A tank 12 allocating the sterile agent having a pressure relief valve 13 coupled ahead thereof and being held at a constant pressure is disposed in the sterile-agent-feeding conduit 1, while a pressure relief valve 9 having a steam volume regulator 10 coupled therebehind is provided in the steam-feeding conduit 8.

Figure 3:
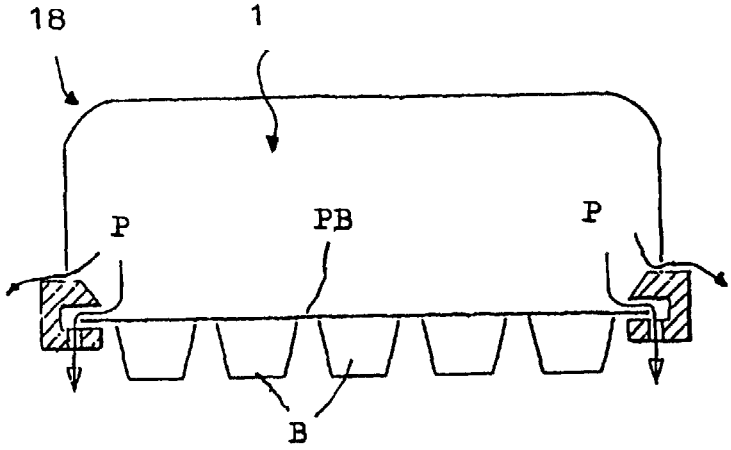
FIG. 3 schematically shows a cross-sectional view of the sterile chamber of the packing machine according to FIG. 1.

FIG. 3 is a cross-sectional view of a so-called semi-tunnel 18 which confines the sterile chamber 1. FIG. 3 also illustrates that the sterile chamber 1 is partially open toward the atmosphere, specifically at the bottom edges 18' of the sterile tunnel 18. The said partially open condition toward the atmosphere enables the permanent off-flow of the sterile air flowing at a slight excess pressure in the sterile chamber 1 during the normal packing operation as indicated by arrows P, but also of the mixture of steam and sterilizing agent during the pre-sterilization presently of interest.

Figure 2:
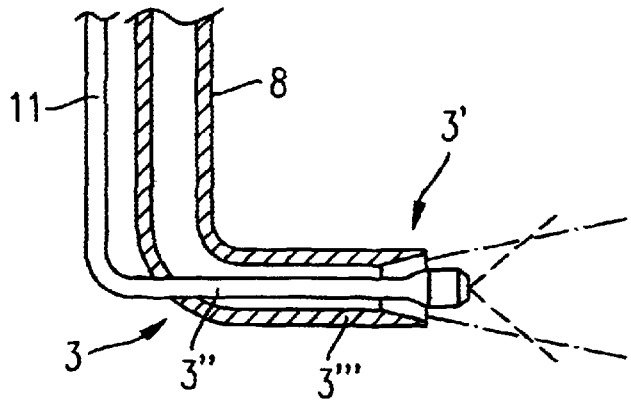
FIG. 2 schematically shows a sectional view of the nozzle for mixing steam and sterilizing agent.

The mixing nozzle 3 in reference to FIG. 2 is designed in the form of a dual nozzle 3', with the so-called nozzle stock 3" serving for introducing the sterile agent which is supplied, for example, at a 35% concentration in aqueous solution as hydrogen peroxide and is sprayed into the steam jet discharged from the conduit 3'" as a flow hose, thereby being intensively mixed with the steam which along with the sterile air carries the sterilizing agent into the whole of the sterile chamber 1, distributing it therein, with the steam along with the sterilizing agent depositing or condensing even in corners and gussets along the walls of the sterile chamber 1 and the tools of treatment contained therein.

During the pre-sterilizing start-up phase, the supply of sterile air for the partial return flow generation of the discharged mixture of sterilizing agent toward the upstream sterile filter 6 is temporarily discontinued for a predetermined period of time to also reach, in an easy way, during the pre-sterilizing process, the sterile air filter 6. The phrase "temporarily discontinued for a predetermined period of time" refers to, for example, between 15 and 30 seconds out of a total pre-sterilization duration of, for example, between about 3 and 5 minutes. For that purpose, the arrangement is so designed that, downstream, at a small distance behind the mixing nozzle 3, a flow resistor (drag) 15 is arranged in the form of a channel buckling as shown on the sterile air feeder 2 conically constricting to that extent. The drive 4' of the blower 4 in a sterile air generator 7 comprising a pre-filter 6' and an air heater 5 for such a temporary interruption of the sterile air supply is provided with an adjustable timer 16.

It is at least during the afore-mentioned pre-sterilizing start-up phase that also the sterile filter 6 on the flow side, is sprayed with sterilizing agent, for which purpose a sterile agent nozzle 17 is arranged ahead of the sterile filter 6 at the in-flowing side which, as shown in FIG. 1 in dash-dotted lines, via the tank 12 allocating the sterilizing agent, is in communication with a conduit 17'.

To avoid a damming up of heat or the formation of a heat bubble in the area of the web pre-heating elements 19 in the machine according to FIG. 1, which would affect the in-flow of the sterilizing agent/steam mixture in the in-flow-sided area 1' of the sterile chamber 1, the temperature thereof, preferably, is held below 120° C. i.e. at a temperature level preferably of between 40 and 80° C. Should the pre-sterilization have to be effectuated after a temporary interruption of the operation of the machine, whereafter the pre-heating elements 19 are still relatively hot, the pre-sterilization would be initiated only after the said elements having cooled down accordingly. This process via temperature sensors anyway provided in this area with machines of this type could be monitored and supervised by the machine control.

Figure 4:
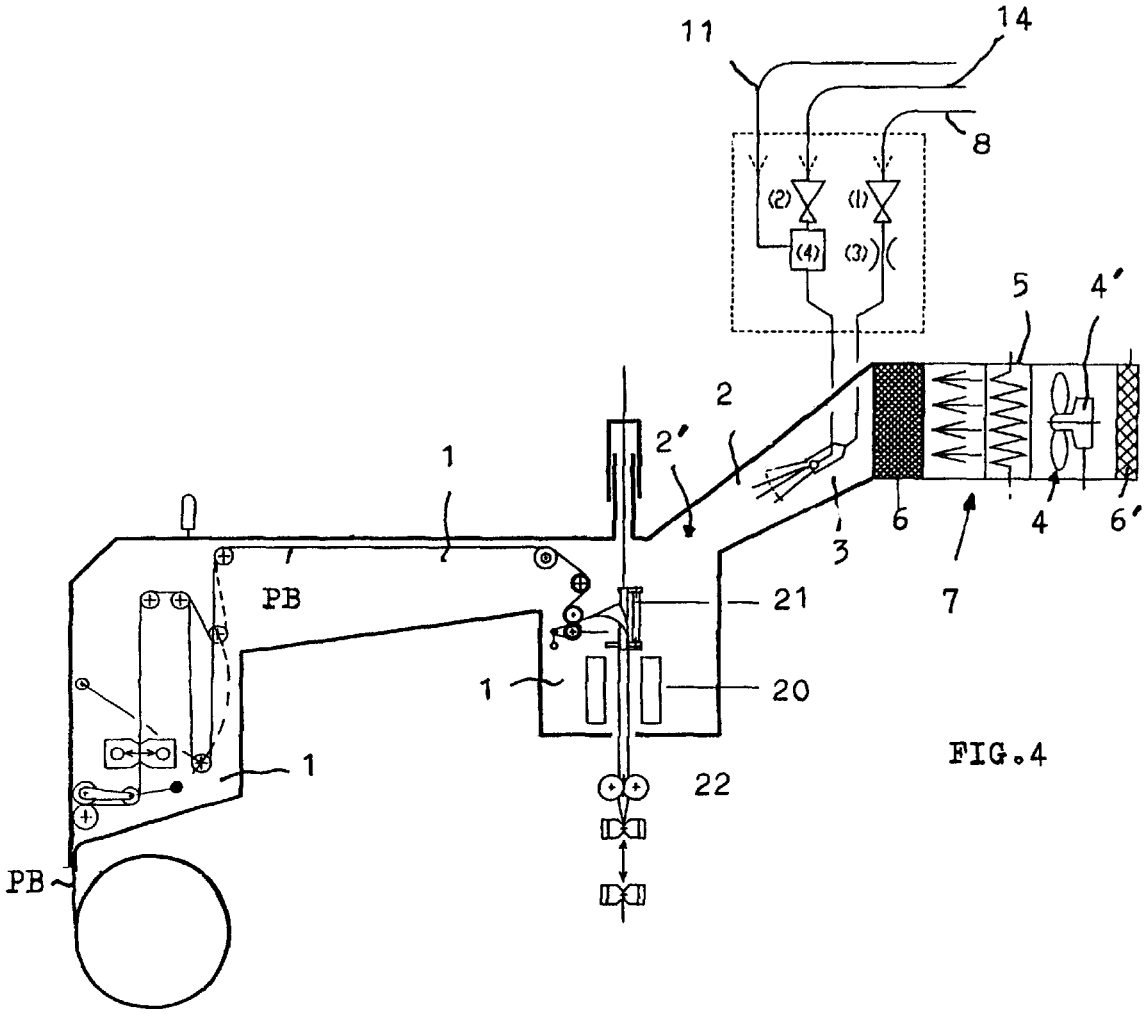
FIG. 4 shows side and sectional views of a packing machine designed according to the invention for making tubular bags.

The same applies to the packing machine shown in FIG. 4 which is a tubular bag making machine. The heatable elements which in that embodiment will have to be cooled, i.e. temperature-regulated, for pre-sterilizing purposes, are the elongated seal jaws 20 by way of which the tube 22 of the web of packing foil molded on the forming tube 21 is longitudinally sealed. As the way of operation of tubular bag producing machines of this type is adequately known in the art, no detailed description thereof is required. Incidentally, in respect of corresponding elements of a tubular bag producing machine the same reference numerals have been used as in the deep-drawing packing machine described in FIG. 1.

The afore-mentioned temperature regulation as well as all other controlling or regulating requirements can be part of a general control (not shown in any detail) of the packing machine in question, irrespective of whether or not it is a machine according to FIG. 1 or FIG. 4.

Also, the pre-sterilizing process is identical in both cases which, in summary, is carried out in a preferred form of embodiment as follows:

The tools of treatment possibly still hot as contained in the sterile chamber, prior to commencement of the pre-sterilizing process, by cooling down, are brought to a temperature below 120° C., i.e. to a temperature of the mixture of steam and sterilizing agent below the dew point, preferably to between 40–80° C. In the event that the machine has been cooled off due to an extended stand-still period, the heater of the preheating elements 100 or of the elongated seal yaws 20 is turned on until the latter have reached this temperature.

The mixture of water vapor and sterilizing agent (hydrogen peroxide) is effectuated directly in the mixing nozzle 3 to which both components are supplied; the water vapor/sterilizing agent is introduced at one single point within the sterile air supply channels 2 downstream directly behind the sterile filter 6 in the same direction as the previously switched-on and in-flowing sterile air toward the sterile chamber 1. To insure a thorough mixture of steam and sterile agent, the sterilizing agent is centrally introduced into the water vapor discharged in the form of a hose. To further enhance the mixture, the entire flow of sterile air, steam and sterilizing agent can be accelerated by conically constricting the channel 2 leading to the sterile chamber 1, resulting in a higher turbulence of the flow.

The steam supply to the nozzle is through a pressure relief valve and a means regulating the steam volume as coupled thereto, while the supply of the sterilizing agent to the nozzle is from the stock of sterilizing agent held at a constant pressure, or from the allocating tank 12 containing the amount of sterile agent required for pre-sterilizing purposes. The said pressure and volume regulation of steam and sterilizing agent is important to satisfy the conditions and requirements to insure a faultless pre-sterilization.

During the start-up pre-sterilizing phase the sterile air supply for a short period of time of between 15 to 30 seconds is discontinued to thereby cause the discharged mixture of steam and sterilization agent to flow back to a certain extent toward the sterile air filter 6, equally exposing the latter to the sterilizing agent.

Moreover, also the sterile filter 6, at least during the pre-sterilizing start-up phase, at the air in-flow side, is equally sprayed by sterilizing agent.

As it can be proceeded from the assumption, irrespective of whether the pre-sterilization to be effectuated is preceded by an extended standstill period or only by a short-time temporary interruption, that some moisture regularly deposits on the walls of the sterile chamber or on the treatment tools, which, as mentioned hereinbefore, would affect the desired condensation of the mixture of steam/sterilization agent, advantageously, prior to commencement of the actual pre-sterilizing process, the sterile chamber and the treatment tools contained therein are dried by the supply of sterile air supplied through the sterile filter, with the sterile air, for drying, being supplied at a temperature in the order of between 40 and 80° C., for which purpose the sterile air generator 7 is furnished with a correspondingly adjustable heater 5.

Along with the pre-drying and cooling or heat-up period regulated temperature) of the treatment tools, the whole of the pre-sterilization takes relatively little time, i.e. about 12 to 20 minutes only, depending on the type and size of the machine, whereupon, by maintaining the sterile air supply but discontinuing the supply of steam and sterilizing agent, the sterile chamber 1 is blown, dried whereafter the packing machine is conventionally put into operation.

What is claimed is:

1. An aseptically operating packing machine, comprising a processing track with tools for treating a web of a packing sheet, the processing track being arranged within a sterile chamber partially open the atmosphere; a nozzle for a sterile air generator provided with a blower, a hater and a sterile air filter, a mixing nozzle arranged downstream directly behind the sterile air filter, within an air channel terminating in the sterile chamber, the mixing nozzle being connected to a steam and a sterilizing agent supply conduit and disposed to point in a downstream direction of the sterile air channel towards the sterile chamber; a tank for allocating the sterilizing agent held at constant pressure by a pressure relief valve coupled upstream of the tank, the tank being arranged in the sterilizing agent supply conduit; and another pressure relief valve, including a steam volume regulator coupled downstream of the other pressure relief valve arranged in the steam supply conduit.

2. The machine according to claim 1, wherein the mixing nozzle is a dual nozzle with a central nozzle stock connected to the sterilizing agent supply conduit branching from the allocating tank.

3. The machine according to claim 1, wherein disposed downstream and spaced from the mixing nozzle, within the sterile air channel, is a flow drag means.

4. The machine according to claim 1, wherein the blower has a drive connected to an adjustable timer.

5. The machine according to claim 1, wherein a nozzle for the sterilizing agent is arranged upstream of the sterile filter, and a conduit connects said nozzle with the tank allocating the sterilizing agent.

6. A process for pre-sterilizing sterile spaces of aseptically operating packing machines, wherein, prior to commencement of the operation of the packing machine, a sterilizing agent mixed with water vapor as a carrier medium is sprayed into a sterile chamber partially open toward the atmosphere and held at a slight excess pressure while a web of a packing sheet is introduced into the sterile chamber containing tools for treating the web of the packing sheet, and air filtered by a sterile filter is supplied during the pre-sterilizing process, which comprises the following process steps:

a) the treatment tools still hot and contained in the sterile chamber, prior to commencement of the pre-sterilizing process, are brought to a temperature below 120° C.;

b) the water vapor and sterilizing agent are moved in a nozzle to which both components are supplied;

c) the water vapor/sterilizing agent mixture is introduced at a single spot downstream directly behind the sterile filter in the same direction as the in-flowing sterile air toward the sterile chamber;

d) the steam supply to the nozzle is effectuated by a pressure relief valve followed by a subsequent regulation of the steam volume, while the supply of sterilizing agent to the nozzle is effectuated from a stock of sterilizing agent held at a constant pressure; and e) during the pre-sterilizing start-up phase, the sterile air supply for the purpose of a partial return-flow generation of the discharged mixture of water vapor/sterilizing agent upstream toward the sterile air filter is temporarily discontinued.

7. The process according to claim 6, wherein the sterilizing agent is centrally sprayed into the water vapor discharged from the nozzle.

8. The process according to claim 6, wherein at least during the pre-sterilizing start-up phase the sterile filter, on the air in-flow side, is also sprayed by the sterilizing agent.

9. The process according to claim 6, wherein the mixture of water vapor, sterilizing agent and sterile air, prior to entrance into the sterile chamber, is guided through a constricted flow section.

10. The process according to claim 6, wherein the sterile chamber inclusive of the tools for treating the web of the packing sheet are adjusted to a temperature below the condensation temperature of the mixture of water vapor/sterilizing agent.

11. The process according to claim 6, wherein prior to commencement of the actual pre-sterilization, the sterile chamber along with the treatment tools contained therein are dried and temperature-regulated by the supply of sterile air supplied through the sterile filter.

12. The process according to claim 11, wherein the sterile drying air is supplied at a temperature between 40 and 80°.

* * * * *